US007246643B2

(12) United States Patent
Andrews

(10) Patent No.: US 7,246,643 B2
(45) Date of Patent: Jul. 24, 2007

(54) TRANSFORMABLE PURSE SYSTEM

(75) Inventor: Sharon Barber Andrews, Benton, AR (US)

(73) Assignee: Sharon Barber LLC, Little Rock, AR (US)

( * ) Notice: Subject to any disclaimer, the term of this patent is extended or adjusted under 35 U.S.C. 154(b) by 483 days.

(21) Appl. No.: 10/808,140

(22) Filed: Mar. 24, 2004

(65) Prior Publication Data

US 2004/0187988 A1 Sep. 30, 2004

Related U.S. Application Data

(60) Provisional application No. 60/458,183, filed on Mar. 27, 2003.

(51) Int. Cl.
*A45C 13/10* (2006.01)
*A45C 13/26* (2006.01)

(52) U.S. Cl. ..... 150/105; 150/103; 150/107; 150/118; 150/127; 190/116; 238/110

(58) Field of Classification Search ..... 150/103–108, 150/118; 190/116; 159/110, 127
See application file for complete search history.

(56) References Cited

U.S. PATENT DOCUMENTS

| | | | | | |
|---|---|---|---|---|---|
| 1,704,040 | A | * | 3/1929 | Fingerman | 150/118 |
| 1,945,268 | A | * | 1/1934 | Fielding | 40/655 |
| 1,990,360 | A | * | 2/1935 | Anish | 150/105 |
| 2,006,463 | A | * | 7/1935 | Landis | 150/104 |
| 2,131,382 | A | * | 9/1938 | Lobel | 150/105 |
| 2,723,696 | A | * | 11/1955 | Kase | 150/105 |
| 2,798,524 | A | * | 7/1957 | Ryon | 150/103 |
| 3,182,701 | A | * | 5/1965 | Ginsburg | 150/105 |
| 3,964,529 | A | | 6/1976 | Brod | |
| 4,856,570 | A | | 8/1989 | Rushing et al. | |
| 4,907,633 | A | | 3/1990 | Eckstein | |
| 5,119,910 | A | * | 6/1992 | Heggeland | 190/116 |
| 5,503,204 | A | * | 4/1996 | Byers et al. | 150/105 |
| 5,533,558 | A | | 7/1996 | Carey et al. | |
| 5,881,787 | A | | 3/1999 | Davis et al. | |
| 5,881,932 | A | * | 3/1999 | Wadden | 224/153 |
| 5,911,262 | A | | 6/1999 | Steinhart | |
| 6,003,573 | A | | 12/1999 | Owens | |
| 6,029,723 | A | | 2/2000 | Baquero et al. | |
| 6,129,126 | A | * | 10/2000 | Restivo | 150/105 |
| 6,382,280 | B1 | | 5/2002 | Sands | |
| 2002/0015538 | A1 | * | 2/2002 | Snider | 383/18 |
| 2003/0177664 | A1 | | 9/2003 | Monassebian | |

* cited by examiner

*Primary Examiner*—Sue A. Weaver
(74) *Attorney, Agent, or Firm*—J. Charles Dougherty

(57) ABSTRACT

A transformable purse system that includes a base, multiple purse covers, multiple handle options, and alternatively multiple decorative clip options. The covers wrap around the purse base such that the ends of the base are left exposed and the end of the cover forms a lid. The decorative clips may be attached at the point where the lid fastens to the purse. The covers may be attached with hook-and-loop fasteners such that they are easily interchangeable without removing the contents of the purse. The straps may similarly be attached using hook-and-loop fasteners and rest in grooves in the base ends, and may be further secured in place using rods at the top of the base ends.

14 Claims, 2 Drawing Sheets

TRANSFORMABLE PURSE SYSTEM

CROSS-REFERENCE TO RELATED APPLICATIONS

This application claims priority from U.S. provisional patent application No. 60/458,183, filed on Mar. 27, 2003, by inventor Sharon L. Wyatt, and entitled "Transformable Purse System." This provisional application is incorporated herein by reference.

BACKGROUND OF THE INVENTION

The present invention relates to purses and handbags, and particularly to a purse system that comprises a frame onto which various coverings, handles, and decorative attachments may be interchangeably attached.

Women who carry handbags or purses often find it necessary or desirable to own a number of such bags. While in some cases it is necessary to own a number of bags for utilitarian reasons, such as carrying capacity, often the desire is based on fashion. It is generally considered desirable to own a selection of bags in varying sizes, styles, and decorative patterns. A bag may be selected for use on a given day because the bag matches or complements the clothes, shoes, or jewelry selected by the owner for wear on that day. In addition, certain styles of bags may be considered appropriate for different functions or different times of day; for example, some bags may be designed for everyday use, while other bags are intended for use in conjunction with evening or formal events.

The necessity for a large number of bags creates a significant financial burden on women, particularly since the most expensive bags are generally the ones that are considered the most desirable. A woman must expend a considerable sum of money in order to maintain a collection of fashionable bags that are appropriate for wear with all of her various clothing, shoe, and jewelry choices and for the various occasions to which she desires to carry a bag.

Another difficulty is that the storage of a large number of handbags or purses may create a burden for a woman who does not have sufficient storage space in her home for the number of bags desired. Even where sufficient space is available, such storage space may be in the top of a closet, attic, or other relatively inaccessible space, which places the owner to great inconvenience if bags are switched often.

Yet another difficulty faced by the owner of a number of bags is that in order to switch the bags from day to day the owner is generally required to remove all of her contents from one bag and transfer those contents to the desired bag. Since handbags and purses often contain various inner pouches, which may be secured with zippers or other fastening devices, the transfer may be cumbersome and time consuming. Women who hurriedly transfer items between purses may lose some small items, or may decide they do not have sufficient time to make a complete transfer and thus carry over only a few essential items to the new purse. As a result of these problems, women who are pressed for time may simply forego the opportunity to select an appropriate purse for their clothing or the event and simply select a purse that, while not as fashionable, represents the best compromise with most events and clothing ensembles.

Recognizing these difficulties, the related art includes a number of attempts to develop handbags and purses with interchangeable components. It has been recognized that a single handbag or purse with interchangeable components may replace many or all of the desired handbags in a woman's collection. For example, U.S. Pat. No. 4,907,633 to Eckstein teaches a handbag with interchangeable coverings, with the coverings each consisting of two sidewalls and a separate endwall piece. The three covering pieces attach to the bag by means of hook-and-loop fasteners. Handle components may be interchanged as well. U.S. Pat. No. 5,911,262 to Steinhart teaches a handbag comprising interchangeable outer shells and an inner shell for holding items. U.S. Pat. No. 5,533,558 to Carey et al. teaches a purse with a separate outer covering that attaches to the purse by means of a clamping arrangement, clamping members being located at the edges of each side of the purse. U.S. Pat. No. 6,003,573 to Owens teaches a handbag arrangement in which the inner shell may be attached to an interchangeable outer shell by means of zippers. U.S. Pat. No. 6,029,723 to Baquero et al. teaches a box-shaped purse housing that may receive various covers that are held in place by snap connectors. U.S. Pat. No. 6,382,280 to Sands teaches a purse that comprises an outer shell into which is fitted a V-shaped expandable frame. The cover is attached at the upper side on each side of the frame. U.S. Patent Application Publication No. 2003/0177664 teaches a handbag with hook-and-loop fasteners designed to receive a fabric sheath that wraps around the bag and, in one example, the closing flap of the handbag.

The related art also includes previous designs intended to allow a purse to be constructed with interchangeable ornamentation. For example, U.S. Pat. No. 5,881,787 to Davis et al. teaches an interchangeable clasp that attaches to a purse flap magnetically, and allows for the fitting of an interchangeable ornament to the outer portion of the clasp.

Each of these designs offer advantages and disadvantages. Many of them would result in a bag that is difficult or expensive to manufacture, either because of the number of parts required or the relatively tight tolerances on parts that are fitted together. The use of a complex outer shell or cover, particularly one that is fitted, would necessarily increase the cost of the interchangeable purse system since the increased cost of manufacturing such a cover is felt with each additional cover purchased. This would thus reduce the effect of one of the most important benefits that derive from using an interchangeable cover, namely, lower cost. In addition, several of these designs involve interchangeable shells and covers that are formed of multiple parts, which would generally increase the amount of time required to reconfigure the purse with a different cover, since each part must be fitted separately. Finally, many of the designs shown in the prior art are dated and would not be considered fashionable today.

What is desired therefore is a handbag or purse system with interchangeable components, where the outer shell or covering is simple and inexpensive to manufacture, and which may be easily and quickly attached and detached. Furthermore, such a desired handbag or purse system must be in a design that is desirable in today's marketplace based on current fashion trends. The previously recited limitations of the related art are overcome, and these desires met, by the present invention as described below.

BRIEF SUMMARY OF THE INVENTION

The present invention is directed to a highly fashionable purse system that allows the owner to select any number of different exterior appearances with the transformation process being relatively simple and quick to perform. In the preferred embodiment, the system comprises a base bag that includes a rigid frame, a plurality of replaceable exterior "wraps," replaceable coordinating handles, and replaceable decorative accessories. Since the base bag is always used, the owner need never move items from one bag to another. The rigid frame allows various wraps to be interchanged very quickly, preferably using hook-and-loop fasteners. The straps may similarly be easily attached and detached from the end panels of the rigid frame. The frame further creates a fashionable shape that makes the purse attractive regardless of the wrap that is chosen by the owner.

It is therefore an object of the present invention to provide for a purse system with interchangeable components such that the purse can be modified to complement any desired clothing, shoes, or jewelry, or modified as appropriate for a particular type of event.

It is a further object of the present invention to provide for a transformable purse with a rigid base that results in a purse with a highly fashionable shape.

It is also an object of the present invention to provide a purse that allows interchangeability of its outer cover, handle, and accessories.

It is also an object of the present invention to provide a purse with a changeable appearance that does not require the transfer of materials in the purse from one bag to another.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENTS

Figure 1:
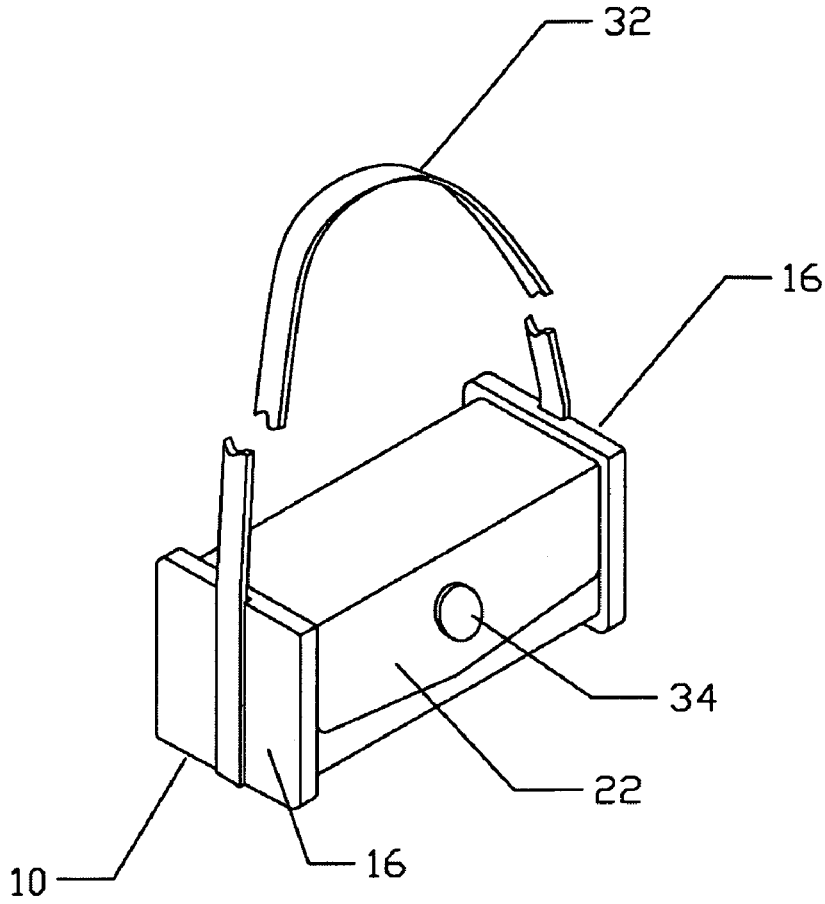
FIG. 1 is a perspective view of a preferred embodiment of the present invention.
Figure 2:
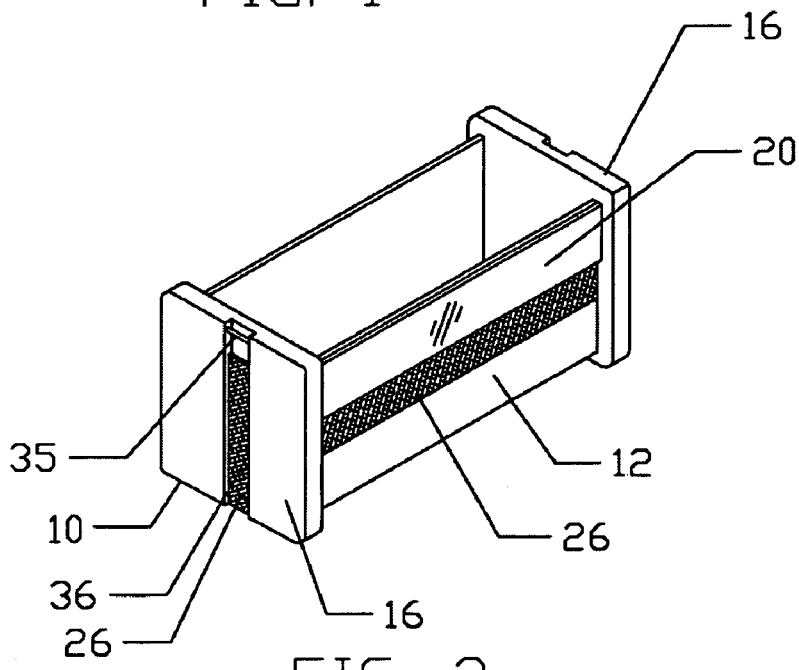
FIG. 2 is a perspective view of the base according to a preferred embodiment of the present invention.

With reference to FIGS. 1 and 2, the preferred embodiment of the present invention may be described. The preferred embodiment comprises a base 10 that forms the main compartment of the purse. The top of base 10 remains open. While the preferred embodiment comprises a base 10 shaped approximately as a rectangular box with an open top, the invention is not so limited and alternative embodiments may comprise any number of different shapes, including without limitation square, cylindrical, and semi-cylindrical. Base 10 may be constructed of any material sufficiently rigid and durable to provide a supporting framework for the purse. While wood has been employed in the preferred embodiment, other material choices in alternative embodiments may include plastics and metals. It may also be noted that base 10 may be constructed in any size that is convenient. In the preferred embodiment, however, base 10 is constructed such that the purse is relatively shallow in order to avoid forcing the owner to "dig" blindly through the purse to find small items. Various types of pockets and compartments may be added to base 10 in order to organize items kept in the purse. Since the preferred embodiment may be configured in many different ways using the same base 10 as described below, and since various pockets and compartments may be added to base 10 for purposes of organization, the user may dispense with the usual requirement of carrying a wallet within the purse if desired.

While in the preferred embodiment much of frame 10 is covered as described hereafter, end walls 16 remain exposed, and thus the finish of end walls 16 must be attractive to the wearer. Ideally the finish of end walls 16 is not only attractive but also amenable to matching with a wide variety of fashions and styles. In the preferred embodiment end walls 16 are formed of finished wood for an attractive appearance, although many other materials are possible. Alternatively, end walls 16 may be formed of an inexpensive material to which an attractive material or coating is applied, including without limitation options such as a fine wood veneer or a fabric covering.

The preferred embodiment further includes mirror 20 mounted on front wall 12 of base 10, as illustrated in FIG. 2. Mirror 20 is mounted so that it is easily accessible to the user when the purse is open, as when make-up or other fashion accessories have been removed from the purse for application, but is not visible to others when the purse is closed. Mirror 20 is shown in an elongated, rectangular shape designed to fit within the space requirements of this particular embodiment of base 10, but many other shapes are possible. Mirror 20 should ideally be as large as reasonably possible for ease of use, while remaining concealed when the purse is closed. Alternative embodiments of the present invention may omit mirror 20.

Figure 3:
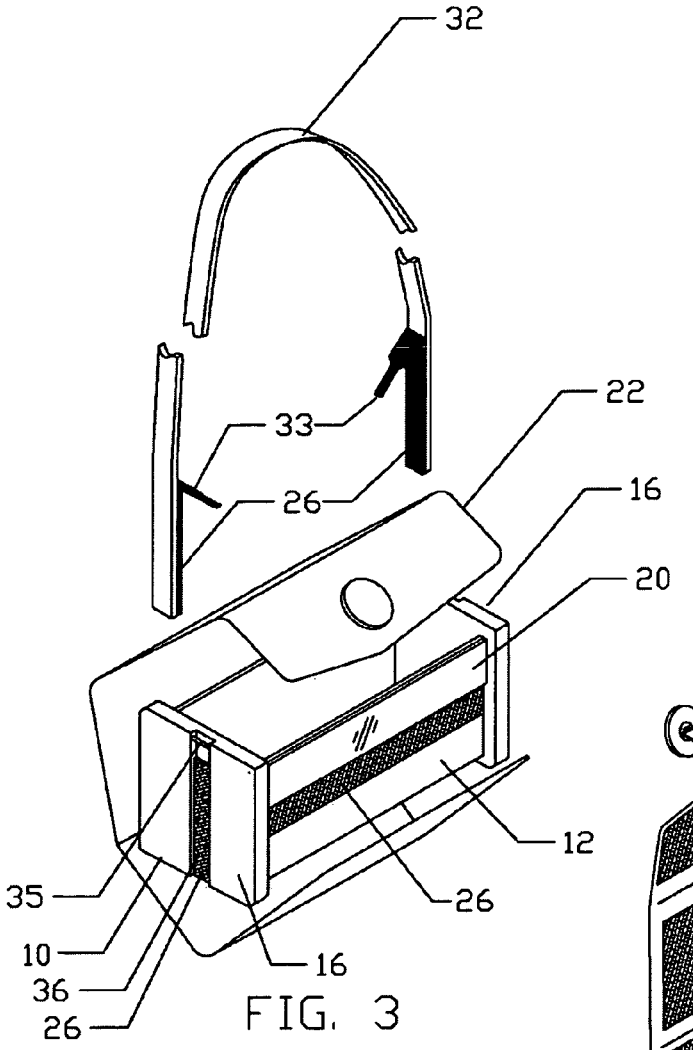
FIG. 3 is an illustration demonstrating the application of a wrap and handle to the base according to a preferred embodiment of the present invention.

Wrap 22 is applied to base 10 in the manner shown in FIG. 3, with the finished closed purse shown in the preferred embodiment of FIG. 1. Wrap 22 forms both the outer covering of the purse (except for the exposed end walls 16) and the covering flap. Although only one wrap 22 is illustrated, the present invention comprises a plurality of wraps 22 in various fashionable colors and materials. Wrap 22 is preferably formed of a flexible material, which may be fabric or otherwise, to which multiple rigid panels are applied for strength. The rigid panels may be formed of cardboard, plastic, or any other sufficiently rigid material to provide shape and support for wrap 22, enabling the user to easily apply wrap 22 to base 10 as described hereafter. The panels may be either on the inside of a layered fabric material as shown in the illustrated preferred embodiment of FIG. 3, or adhered to the inside of the fabric. Small gaps in the application of the rigid panels create creasing points at which wrap 22 may bend in order to fit around base 10. Thus in the illustrated preferred embodiment, five separate rigid panels 24 are employed. Other configurations in alternative embodiments will be employed in order to fit over the particular shape of base 10. It may be noted that due to the creasing points that result from this design of wrap 22, wrap 22 may be easily folded flat for storage while requiring minimal storage space.

In order to apply a wrap 22 to base 10, the following steps are performed as illustrated in FIG. 3. The end of wrap 22 opposite the flap is fitted against front wall 12, with the end of wrap 22 aligned with and butting against mirror 20. Pressing against the end of wrap 22 causes the engagement of a hook-and-loop fastener 26, the two components of which are mounted on front wall 12 and the opposing location on wrap 22. Various types of hook-and-loop fasteners 26 may be employed, including the Velcro brand hook-and-loop fasteners. The size and shape of the fastener tapes are not significant, provided that wrap 22 is securely attached to base 10 while remaining easily removable from base 10. Other types of fasteners may be employed in alternative embodiments, including without limitation snaps and clips.

After the end of wrap 22 opposite the flap is attached at front wall 12, the remaining portion of wrap 22 is wrapped around the bottom and back of base 10. The user simply applies pressure at these points once each section of wrap 22 is fitted in place to engage the appropriate hook-and-loop fastener 26. Wrap 22 is then folded over the top of base 10, and the front flap portion of wrap 22 is draped over front wall 12. An optional flap fastener (not shown) may be of any type that provides a sufficient engagement to hold down the front flap portion of wrap 22 and thereby retain the purse in the closed position, while being easily opened by the user. The flap fastener of the preferred embodiment may comprise, for example, a buckle or a hook-and-loop type fastener. In alternative embodiments, other portions of the inner surface of wrap 22 may be covered with either a hook- or loop-type fastener material such that additional items may be attached at various points, such as under the top section of wrap 22 that covers the open top of base 10. One possible accessory that may attach to wrap 22 in this manner is a pen. Alternatively, a pen holder could be attached. In either case, the item would have attached a hook- or loop-type fastener material as appropriate to receive and engage with the hook- or loop-type fastener material at the attachment point on wrap 22.

Referring again to FIG. 3, a method for attaching a handle strap 32 to the preferred embodiment of the invention may now be described. In the preferred embodiment, a single strap 32 comprises a handle for the purse; in alternative embodiments, various types of handles may be used, including two or more straps 32. Attached near each end of strap 32 are tabs 33. Tabs 33 are preferably formed of the same flexible but strong material as strap 32, but may be of any material sufficiently strong to support the weight of the purse. In order to attach strap 32 to base 10 of the purse, each tab 33 is inserted into a corresponding groove 36. Groove 36 extends vertically along the side of each of end walls 16. Each groove 36 is sized to fit each strap 32 and tab 33, such that strap 32 is flush with the exterior of end walls 16 when strap 32 is engaged with end walls 16. Each groove 36 preferably contains a hook fastener material fitted into it and bonded to base 10. Each tab 33 is inserted into groove 36 to the inside of retainer 35. Retainer 35 is preferably fitted across the face of groove 36 at the top end of groove 36. Tab 33 is then pulled downward and pressed into groove 36. Each tab 33 preferably includes a loop fastener material bonded to the side of tab 33 facing groove 36, such that the loop fastener material of tab 33 engages with the hook fastener material of groove 36, thereby holding tab 33 in place within groove 36. (The hook-and-loop fastener materials may be reversed in an alternative embodiment as desired.) Once tab 33 is in place, the remaining end of handle 32 is pressed into place over tab 33, outside of retainer 35, and into groove 36. Note that tab 33 is positioned on handle 32 such that when tab 33 is properly positioned in groove 36, the end of handle 32 aligns with the bottom of groove 36, thereby presenting a neat appearance. Handle 32 preferably comprises a loop fastener material at its ends below tab 33, thereby allowing handle 32 to engage with groove 36. The process is performed at each end of handle 32 for each side of base 10. Handle 32 is thereby securely attached to base 10, and each end of handle 32 hides each tab 33 so that the appearance of the purse is maintained. It may be noted that handle 32 may be removed and exchanged for a different handle 32 without removing wrap 22, and wrap 22 may be exchanged for a different wrap 32 without removing handle 32, if desired. It may further be noted that this attachment scheme for handle 32 is accomplished with no external hardware; there is thus no problem created by having the hardware style and color not match the jewelry or accessories chosen by the wearer.

Figure 4:
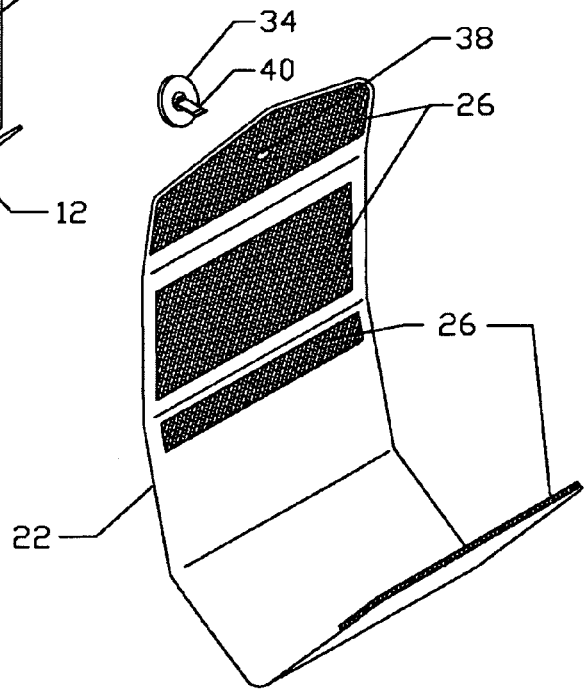
FIG. 4 is an illustration demonstrating the attachment of a deco clip to a wrap according to a preferred embodiment of the present invention.

Referring now to FIG. 4, a method for attaching a decorative clip 34 to a wrap 22 of the preferred embodiment of the invention may be described. As already explained, the preferred embodiment comprises a plurality of wraps 22. Some wraps 22 may be designed for use without a decorative clip 34, while others will not. Further in the preferred embodiment, multiple decorative clips 34 are employed with respect to the various wraps 22 that are designed to receive a decorative clip 34. As a result, the user has many more options for purse configuration since multiple wraps 22 are available, and each wrap 22 may receive multiple clips 34. A user may, for example, desire to match the jewelry or accessories being worn with the chosen decorative clip 34, while matching wrap 22 to the clothes worn by the user. The employment of multiple wraps 22 and multiple decorative clips 34 makes this versatility possible.

Each decorative clip 34 engages with wrap 22 through aperture 38. Decorative clip 34 features hinge 40, which is hingeably attached to the back of decorative clip 34. Hinge 40 may be folded down where it is biased against the back of decorative dip 34, or may be folded upwards where it extends perpendicularly from the back of decorative clip 34.

The present invention has been described with reference to certain preferred and alternative embodiments that are intended to be exemplary only and not limiting to the full scope of the present invention as set forth in the appended claims.

What is claimed is:

1. A handbag, comprising:

(a) a frame comprising two end panels;

(b) a wrap that is removably attached to said frame such that said wrap covers a portion of said frame but said end panels remain exposed;

(c) a handle that is removably attached to said frame at said end panels, wherein said handle comprises a strap, said end panels comprise a vertical groove, and wherein said handle is removably attached to said end panels such that said strap is fitted within said vertical groove; and (d) a retainer rod attached at each of said end panels, wherein said handle further comprises a tab fittable beneath said retainer rod and underneath said strap when said strap is fitted within said vertical groove of said end panels.

2. The handbag of claim 1, wherein said frame comprises a bottom panel, a front panel, a back panel, and an open top.

3. The handbag of claim 2, wherein said wrap attaches to said front panel and said back panel, and said wrap is foldable over said open top.

4. The handbag of claim 3, further comprising hook-and-loop fasteners connecting said front panel and said wrap and said back panel and said wrap.

5. The handbag of claim 1, further comprising hook-and-loop fasteners connecting said strap to said end panels.

6. The handbag of claim 1, further comprising a decorative clip removably attached to said wrap.

7. The handbag of claim 6, wherein said clip comprises a front panel and a backer, wherein said backer is hingeably connected to said front panel and biased toward said front panel, and said backer is fitted through an aperture in said wrap whereby said clip is secured to said wrap.

8. The handbag of claim 1, wherein said wrap comprises two ends, each of said wrap ends comprising one of a hook detachable fastener component and a loop detachable fastener component, and wherein said fastener components are engageable to secure the handbag closed.

9. The handbag of claim 8, further comprising a mirror attached to said frame, wherein said mirror is exposed when the handbag is open but covered by said wrap when the handbag is closed.

10. A transformable purse system, comprising:

(a) a base comprising two rigid end panels;

(b) a plurality of covers, wherein said covers are adapted to removably attach to said base such that said end panels are exposed;

(c) a plurality of handles, wherein each of said handles are adapted to removably attach to said end panels and wherein each of said handles comprises a substantially flat strap, each of said end panels comprises a vertical groove, and wherein said handle is attached to each of said end panels such that said strap is fitted within said vertical groove of each said end panel; and (d) a retainer rod attached at each of said end panels connecting said strap to each of said end panels at said vertical groove of each said end panel.

11. The system of claim 10, wherein said base comprises an open top, and said covers are adapted to fold over said open top when attached to said base.

12. The system of claim 11, wherein said covers each comprise two ends, and said system further comprising attachment means at each of said ends of said covers whereby the purse may be secured in a closed position when one of said covers is folded over said open top of said base.

13. The system of claim 12, wherein one of said covers is removably attached to said base and each of said ends of such said cover is attached using hook and loop fasteners.

14. The system of claim 10, further comprising a plurality of decorative clips adapted to be removably attached to said covers, wherein each of said clips comprises a hinged backer adapted to fit through an aperture in at least one of said covers whereby each of said clips may be secured to said at least one of said covers.

* * * * *